US005452994A

United States Patent [19]

Erickson

[11] Patent Number: 5,452,994

[45] Date of Patent: Sep. 26, 1995

[54] REFRIGERANT COMPRESSOR

[75] Inventor: Lee J. Erickson, Eagan, Minn.

[73] Assignee: Thermo King Corporation, Pittsburgh, Pa.

[21] Appl. No.: 197,629

[22] Filed: Feb. 16, 1994

[51] Int. Cl.[6] ..... F04B 21/04

[52] U.S. Cl. ..... 417/550

[58] Field of Search ..... 417/550, 551, 417/553; 137/516.17

[56] References Cited

U.S. PATENT DOCUMENTS

| | | | |
|---|---|---|---|
| 1,416,696 | 5/1922 | Dennely | 417/550 |
| 1,439,503 | 12/1922 | Clump et al. . | |
| 1,611,789 | 12/1926 | Spreen . | |
| 1,682,736 | 9/1928 | Berry . | |
| 1,973,103 | 9/1934 | Replogle | 417/550 |
| 2,006,583 | 7/1935 | Dennison . | |
| 2,011,079 | 8/1935 | Replogle . | |
| 2,089,630 | 8/1937 | Teeter | 417/550 |
| 2,117,601 | 5/1938 | Browne . | |
| 2,158,351 | 5/1939 | Ames et al. . | |
| 3,428,081 | 2/1969 | Kauffman et al. . | |
| 3,490,683 | 1/1970 | Kocher . | |
| 4,444,219 | 4/1984 | Hollenstein . | |
| 4,627,464 | 12/1986 | Hartshorn . | |
| 4,643,220 | 2/1987 | Hartshorn . | |
| 4,723,572 | 2/1988 | Tuymer . | |
| 4,834,632 | 5/1989 | Gatecliff et al. . | |
| 4,945,946 | 8/1990 | Gangloff . | |
| 5,080,565 | 1/1992 | Schultz et al. . | |
| 5,106,278 | 4/1992 | Terwilliger . | |
| 5,163,819 | 11/1992 | Pettitt | 417/550 X |
| 5,174,735 | 12/1992 | Gannaway . | |

*Primary Examiner*—Richard E. Gluck

[57] ABSTRACT

A refrigerant compressor having a cylinder assembly which includes a piston mounted for reciprocal movement within a cylinder to provide suction and compression strokes which respectively introduce and compress a refrigerant vapor which may have entrained compressor lubricant. The piston includes a suction ring valve which is operated by pressure differentials during the suction and compression strokes to cause the suction ring valve to contact predetermined end surfaces of a predetermined end portion of the piston during the compression stroke and thereby close a refrigerant vapor supply opening surrounded by the predetermined end surfaces, and to cause the suction ring valve to lift from the predetermined end surfaces of the piston during the suction stroke to open the refrigerant vapor supply opening and introduce refrigerant vapor into a compression chamber of the cylinder assembly. The predetermined end surfaces of the piston include an open ended spiral groove which provides a spiral support surface for the suction ring valve, and a spiral depression which collects compressor lubricant entrained in refrigerant vapor, to provide support for the suction ring valve while reducing stiction forces created between the suction ring valve and the piston.

9 Claims, 5 Drawing Sheets

FIG. 2
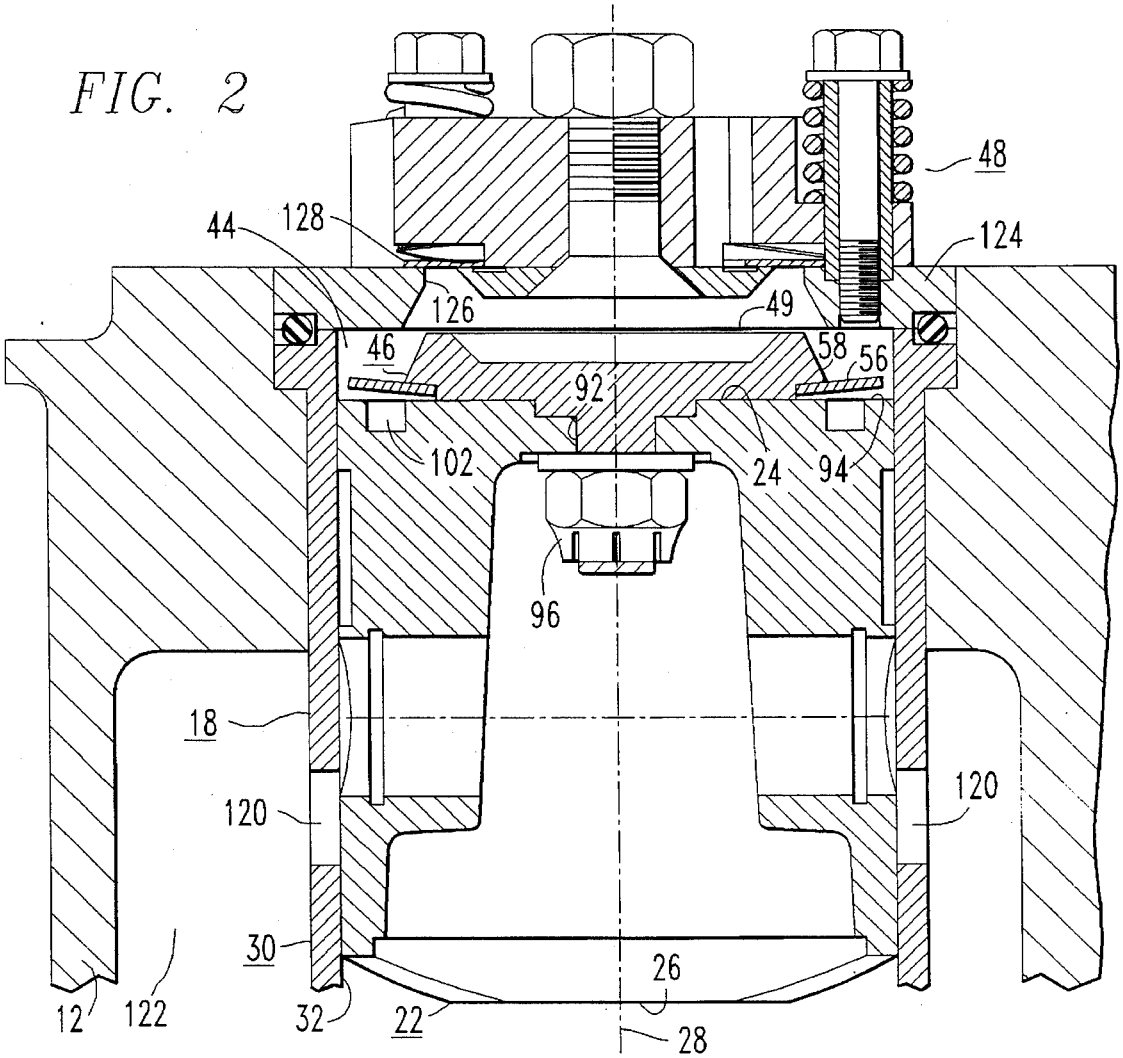
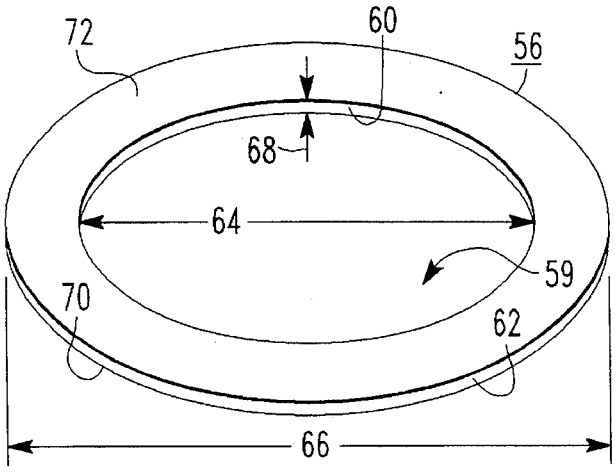
FIG. 2A
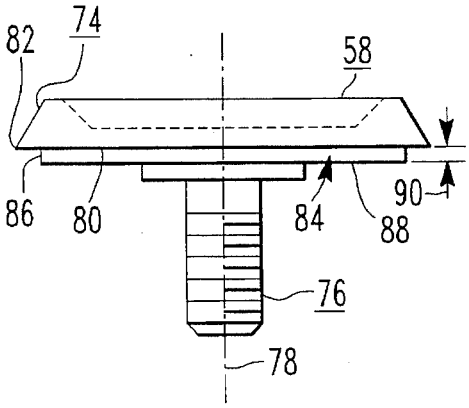
FIG. 2B

FIG. 3
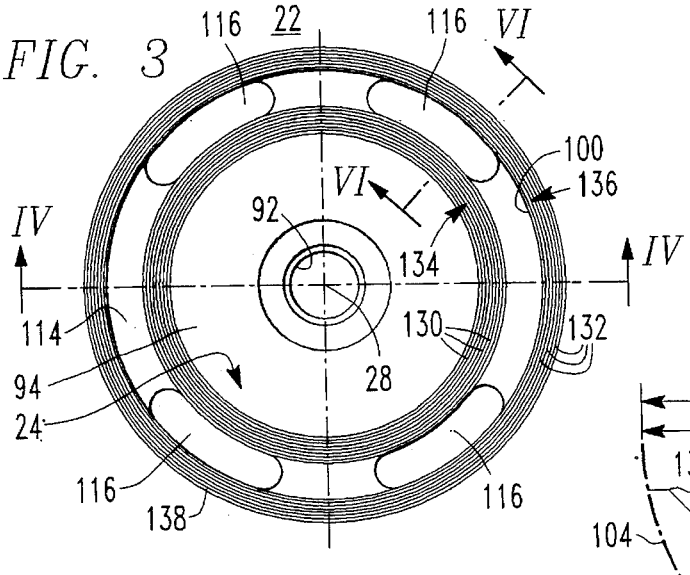
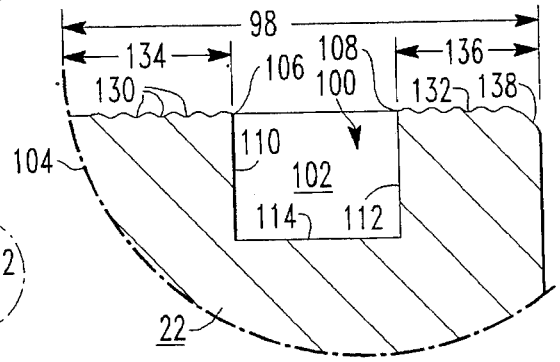
FIG. 5
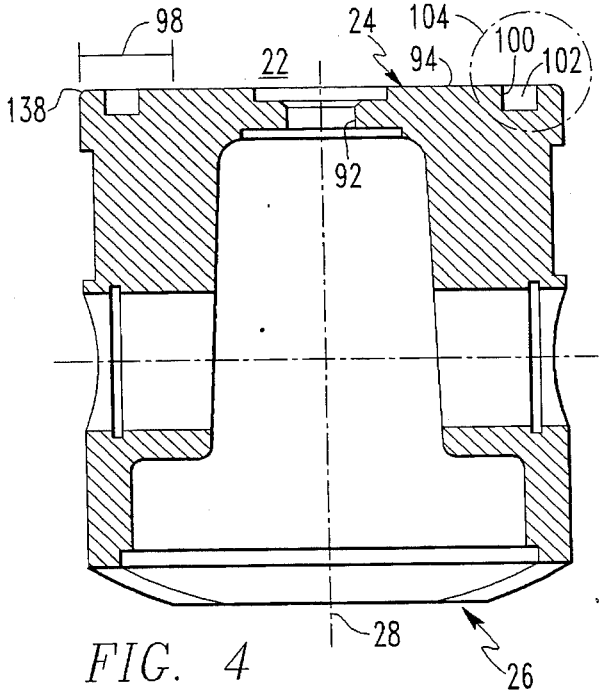
FIG. 4
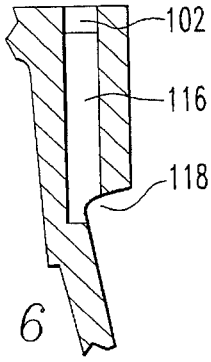
FIG. 6
FIG. 8
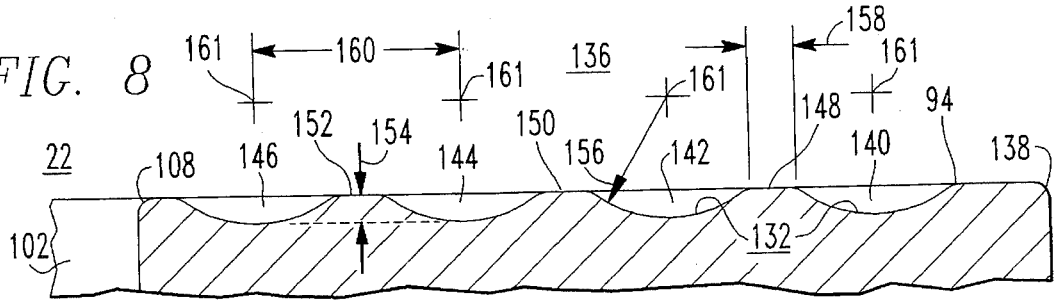

REFRIGERANT COMPRESSOR

TECHNICAL FIELD

The invention relates in general to a refrigerant compressor, and more specifically to a refrigerant compressor having a refrigerant inlet valve integral with each piston.

BACKGROUND ART

Refrigerant compressors having a refrigerant suction ring valve integral with each piston have been successfully used for many years. Recently, the use of new refrigerants, coupled with more demanding performance requirements, have produced pressure and temperature conditions which, in certain instances, have resulted in premature failure of the suction ring valve. The exact cause and solution have not been readily apparent, as evidenced by experimental changes to the suction valve structure which have been tried but which have not produced the desired improvement.

SUMMARY OF THE INVENTION

I have found that failure producing stresses on the suction ring valve are related to a sticking phenomenon which occurs during each opening or suction stroke of a piston. The suction ring valve is theoretically free to move between closed and open positions in response to pressure differentials which occur during compression and suction strokes of each piston. When the piston is in a compression or closing stroke, the suction ring valve is forced against the end surface of the associated piston, covering and closing an annular channel which is in fluid flow communication with a suction manifold portion of the compressor. When the piston is in a suction or opening stroke, the pressure above the end surface of the piston drops below the pressure in the suction manifold, and the suction ring valve is supposed to open immediately upon this pressure change to introduce new refrigerant vapor into a compression chamber for compression on the subsequent compression stroke.

I have found that the suction ring valve does not respond immediately to the pressure differential as the piston enters the suction stroke. Even though prior art suction ring valve and piston designs are arranged to minimize the area of contact between the suction ring valve and piston, to reduce adhesive forces therebetween called "stiction" forces, created when two smooth surfaces are in contact with a film of lubricating oil between them, I have found that the opening of the suction ring valve is delayed until later in the suction stroke due to excessive stiction forces created between the minimized area of contact between the suction ring valve and piston. The smooth surfaces involved in creating the stiction forces include the portions of the suction ring valve in contact with the flat surfaces on the end of the piston which are adjacent to the annular channel and covered by the suction ring valve. The lubricating oil includes oil from the compressor sump which becomes entrained in the refrigerant vapor. Thus, the pressure attempting to open the suction ring valve continues to build until it overcomes the stiction force, at which time the stiction force is suddenly reduced to zero, while the increased pressure in the opening direction creates forces which slam the suction ring valve into a stop which determines the dimension the suction ring valve is allowed to move during the suction stroke. These shock forces on the suction ring valve, occurring during each suction stroke of the associated piston, can cause premature failure of the suction ring valve.

In response to this appreciation of what has been causing failure problems of the suction valve, the invention is a refrigerant compressor having a cylinder assembly which includes a piston having first and second ends, and a longitudinal axis which extends therebetween. The piston is mounted for reciprocal movement within a cylinder to provide suction and compression strokes which respectively introduce and compress a refrigerant vapor which may have entrained compressor lubricant. The piston includes a suction ring valve at the first longitudinal end which is operated by pressure differentials during the suction and compression strokes. During the compression stroke the suction ring valve is caused to contact a predetermined end surface at the first longitudinal end of the piston, to close a refrigerant vapor supply opening which is completely surrounded or enclosed by the predetermined end surface. During the suction stroke the suction ring valve is raised from the predetermined end surface to open the refrigerant vapor supply opening and introduce refrigerant vapor into a compression chamber of the cylinder assembly.

The predetermined end surface of the piston includes an open ended spiral groove which provides a spiral support surface for the suction ring valve, and a spiral depression which collects compressor lubricant entrained in refrigerant vapor to be compressed during the compression stroke of the piston. Thus, the spiral groove provides support for the suction ring valve while reducing stiction forces created between the suction ring valve and the piston.

BRIEF DESCRIPTION OF THE DRAWINGS

The invention will become more apparent by reading the following detailed description in conjunction with the drawings, which are shown by way of example only, wherein:

FIG. 2 is an enlarged cross sectional view of one of the cylinder arrangements of the refrigerant compressor shown in FIG. 1, illustrating the desired opening of a suction ring valve element at the start of the opening suction stroke of the associated piston;

FIG. 2A is a perspective view of the suction ring valve element shown in cross section in FIG. 2;

FIG. 2B is an elevational view of the suction ring valve element retainer shown in cross section in FIG. 2;

FIG. 3 is a view of the valved end of the piston shown in FIG. 2, without the suction ring valve, in order to more clearly illustrate the teachings of the invention, which include providing relatively shallow spiral grooves in the flat end surfaces of the piston which are contacted by the suction ring valve during the compression stroke;

FIG. 4 is a cross sectional view of the piston shown in FIG. 3, taken between and in the direction of arrows IV—IV in FIG. 3;

FIG. 5 is an enlargement of a portion of the end surface of the piston shown in FIG. 4, illustrating spiral grooves formed on each side of an annular channel shown in FIG. 3, which annular channel is closed by the suction ring valve during the compression stroke of the piston;

FIG. 6 is a fragmentary cross sectional view of the piston shown in FIG. 3, taken between and in the direction of arrows VI—VI;

FIG. 8 is a greatly enlarged cross sectional view of the spiral groove shown in FIG. 5, illustrating exemplary dimensional relationships which have been found to be successful;

DESCRIPTION OF PREFERRED EMBODIMENTS

Figure 1:
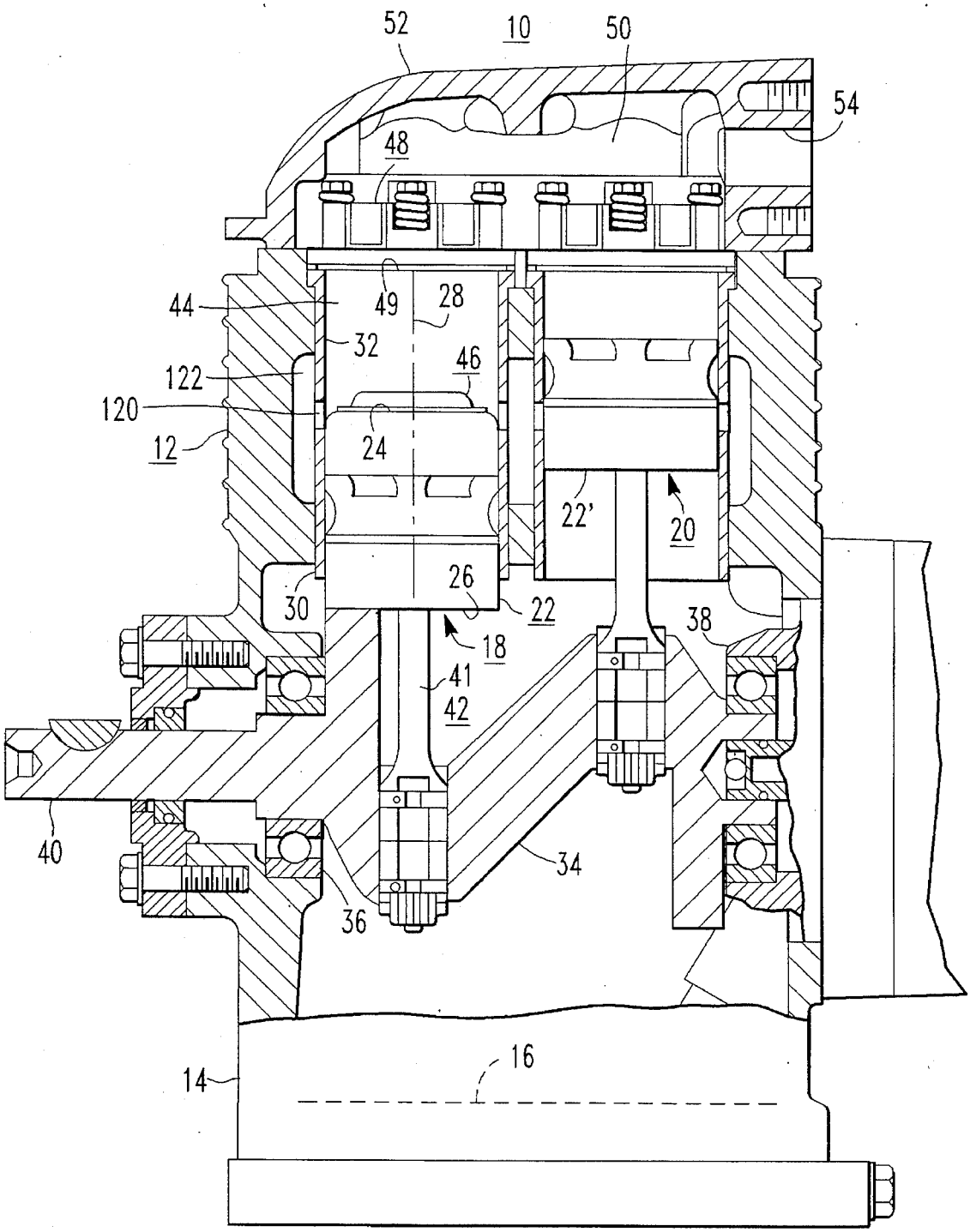
FIG. 1 is an elevational view, shown partially in section, of a refrigerant compressor having cylinder arrangements which include a suction ring valve on each piston, which construction may be improved by the teachings of the invention.

Referring now to the drawings, and to FIG. 1 in particular, there is shown a refrigerant compressor 10 of the type which may be constructed according to the teachings of the invention. Refrigerant compressor 10 includes a frame 12, the bottom portion of which defines a combination support base and sump 14 which includes a supply of compressor lubricating oil, indicated by reference 16. Refrigerant compressor 10 includes one or more cylinder assemblies, such as first and second cylinder assemblies 18 and 20, respectively. Since each of the cylinder assemblies are of like construction, only the first cylinder assembly 18 will be described in detail. Components of the second cylinder assembly 20 which are the same as the first cylinder assembly 18 will be identified with like reference numerals with the addition of a prime mark.

Cylinder assembly 18 includes a cylindrical piston 22 shown at bottom dead center. A piston 22' of the second cylinder assembly 20 is illustrated at top dead center. Piston 22, which may be formed of a high silicon aluminum alloy, for example, has first and second longitudinal ends 24 and 26, respectively, and a longitudinal axis 28 which extends between the first and second longitudinal ends 24 and 26. Cylinder assembly 18 further includes a cylinder 30 supported by frame 12, with cylinder 30 having a bore 32. Piston 22 is mounted for reciprocal movement in the bore 32 of cylinder 30 by a crankshaft 34 which is supported by frame 12 and by bearing assemblies 36 and 38. Crankshaft 34 includes a drive shaft portion 40 which extends outside frame 12 for connection to a prime mover, such as an internal combustion engine and/or an electric motor. A connecting rod 41 interconnects crankshaft 34 and a wrist pin (not shown) mounted within an opening which extends inwardly from the second longitudinal end 26 of piston 22.

The portion of frame 12 below the second longitudinal end 26 of piston 22 defines a suction manifold 42, with relative cool refrigerant vapor being introduced into suction manifold 42 via an appropriate opening in frame 12. As will be hereinafter explained, refrigerant vapor from suction manifold 42 is introduced into a compression chamber 44 located above the first longitudinal end 24 of piston 22 via a suction ring valve assembly 46 carried by the first longitudinal end 24 of piston 22. A discharge valve assembly 48 is mounted above an upper end 49 of cylinder 30, which controls flow of compressed refrigerant vapor into a discharge manifold 50 defined by a cylinder head or closure cover 52 which is fixed to an upper end portion of frame 12. Compressed refrigerant vapor is directed to an external refrigerant flow path via an opening 54 in closure cover 52.

FIG. 2 is a cross sectional view of the first cylinder assembly 18, which illustrates suction ring valve assembly 46 and discharge valve assembly 48 in greater detail. Cylinder assembly 18 is illustrated with piston 22 just below top dead center, entering the downward suction stroke. Suction ring valve assembly 46 includes a suction ring valve element 56, hereinafter called suction ring valve 56, and a valve element retainer 58, hereinafter called valve retainer 58. Suction ring valve 56, as shown more clearly in FIG. 2A, is a relatively thin metallic disc, devoid of openings, other than a central opening 59. Suction ring valve 56, which is preferably formed of a martensitic stainless steel, such as a stainless steel of the 400 series, has inner and outer edges 60 and 62, respectively, which define predetermined inner and outer diameters 64 and 66, and a thickness dimension 68. Inner and outer edges 60 and 62 terminate at first and second flat smooth parallel surfaces 70 and 72, respectively. As illustrated in FIG. 2, suction ring valve 56 is constructed to enable an outer annular portion thereof to flex upwardly when open. The amount of flexing which occurs is a function of the pressure drop across suction ring valve 56 and the amount of energy this pressure drop imparts to suction ring valve 56 while it is open.

Valve retainer 58, shown more clearly in elevation in FIG. 2B, includes a disc shaped portion 74 and an integral depending threaded shaft portion 76, all symmetrical about a longitudinal axis 78. Valve retainer 58, for example, may be formed of a free-machining steel, suitably case hardened, such as via the nitriding process. The disc shaped portion 74 has a flat surface 80, the plane of which is perpendicular to longitudinal axis 78. Surface 80 extends inwardly from an outer edge 82 to a step portion 84 having a cylindrical surface 86 concentric with longitudinal axis 78, and a flat surface 88, the plane of which is parallel with flat surface 80.

Cylindrical surface 86 has a diameter which is selected to receive the inner diameter 64 of suction ring valve 56 with a snug but sliding fit, as cylindrical surface 86 functions as a guide for suction ring valve 56 during its operation. Cylindrical surface 86 has a predetermined dimension 90, measured in a direction parallel with longitudinal axis 78. The predetermined dimension 90 is equal to the thickness dimension 68 of suction ring valve 56 plus the desired amount of movement of suction ring valve 56 during its operation. Surface 80 thus functions as a stop for an inner annular portion of suction ring valve 56 during opening thereof. As illustrated in FIG. 2, suction ring valve 56 is placed on the cylindrical guide surface 86 of valve retainer 58 and then the threaded shaft portion 76 of valve retainer 58 is inserted into a central opening 92 in the first longitudinal end 24 of piston 22. Surface 84 of valve retainer 58 rests against a surface 94 which defines the first longitudinal end of piston 22. A washer and nut combination 96 secures valve retainer 58 to piston 22.

FIGS. 2, 3 and 4 illustrate a first embodiment of piston 22, with FIG. 3 being a plan view of the first longitudinal end 24 of piston 22, and with FIG. 4 being a cross sectional view of piston 22, taken between and in the direction of arrows IV—IV in FIG. 3. A predetermined portion 98 of end surface 94 includes an annular opening 100 concentric with longitudinal axis 28 which forms an annular channel 102 at the first longitudinal end 24 of piston 22. An imaginary broken circle 104 shown in FIG. 4 includes the hereinbefore mentioned predetermined portion 98 of end surface 94, with the portion of piston 22 bounded by broken circle 104 being shown greatly enlarged in FIG. 5.

Annular channel 102 has inner and outer edges 106 and 108 concentric with longitudinal axis 28, inner and outer vertical side portions 110 and 112 which extend inwardly from end surface 94 from the inner and outer edges 106 and 108, respectively, and a bottom portion 114. As best shown in FIG. 3, a plurality of spaced openings 116 are formed in bottom portion 114 which extend towards the second longitudinal end 26 of piston 22 until they communicate with depressions formed by a plurality of circumferentially spaced inwardly stepped side portions of piston 22, such as the inwardly stepped side portion 118 shown in FIG. 6. FIG. 6 is a fragmentary cross sectional view of piston 22 taken between and in the direction of arrows VI—VI in FIG. 3. The inwardly stepped side portion 118 of piston 22 is in communication with suction manifold 42 via appropriately placed openings 120 in the side wall of cylinder 30. Openings 120 are surrounded by a cavity portion 122 defined by frame 12, and cavity portion 122 is in communication with suction manifold 42.

In the operation of cylinder assembly 18, on the downward suction stroke, refrigerant vapor from suction manifold 42, along with any entrained compressor lubricating oil 16, is drawn into compression chamber 44, through the path which includes cavity portion 122, openings 120, openings 116, channel 102, and the now open suction ring valve 56. The pressure on the upper surface 72 of suction valve element 56 during the downward suction stroke of piston 22 is less than the pressure on the lower surface 70, operating suction valve element 56 to the open position shown in FIG. 2. When piston 22 starts its upward compression stroke, the pressure on the upper surface 72 of suction ring valve 56 exceeds the pressure on the lower surface 70, moving suction ring valve 56 to a closed position which covers channel 102.

As best shown in FIG. 2, the discharge valve assembly 48 includes an end closure plate 124 which includes compressed refrigerant vapor discharge ports 126 which are closed by a spring loaded closure element 128 until the pressure in compression chamber 44 reaches a predetermined value. Disc shaped portion 74 of valve retainer 58 and end closure plate 124 have complementary configurations, to enable a complete compression stroke to be made.

Recently, failures have been occurring in the suction ring valve assembly 46 due to damage to the suction ring valve 56, in compressors which have been using newly developed refrigerants which are to replace those refrigerants which have been suspected of depleting the ozone layer. These refrigerants, along with more demanding performance requirements, have produced new conditions of pressure and temperature within compressor 10, contributing to the problem.

I have found that instead of suction ring valve 56 opening at the proper time during the downward suction stroke of piston 22, that the opening of suction ring valve 56 is being delayed. Then, when opening of suction ring valve 56 does occur, the opening movement is accompanied by forces which propel and slam suction ring valve 56 into the flat stop surface 80 of valve retainer 58. I have found that even with the relatively limited areas of contact between suction ring valve 56 and end surface 94 of piston 22, that suction ring valve 56 is still sticking to end surface 94 of piston 22, due to the hereinbefore described adhesive or sticking forces, called "stiction" forces. The stiction forces are created by a thin coating of compressor lubricating oil 16 which is separated from the refrigerant vapor when the refrigerant vapor strikes surface 70 of suction ring valve 56 during the suction stroke. Compressor lubricating oil 16 thus collects between the lower surface 70 of suction ring valve 56 and piston end surface 94. Instead of suction ring valve 56 lifting at the proper time during the downward suction stroke due to pressure differential above and below suction ring valve 56, the downward movement of piston 22 continues to build the pressure below suction ring valve 56 until it reaches a point where the opening force on suction ring valve 56 exceeds the stiction force which attempts to hold suction ring valve 56 in the closed position. Once the bond between the suction ring valve 56 and end surface 94 is broken, the stiction force suddenly collapses, and the now higher than normal opening forces slam suction ring valve 56 into valve retainer 58. This continual shocking of suction ring valve 58 during each suction stroke of piston 22 eventually causes destructive damage, resulting in failure of suction ring valve assembly 46.

I have found that by providing one or more relatively shallow spiral grooves in portions of the end surface 94 of piston 22 which are contacted by the suction ring valve 56, that the early failure problems associated with suction ring valve 56 can be substantially reduced. In the embodiment of piston 22, first and second spiral grooves 130 and 132 are provided in first and second predetermined surfaces 134 and 136, respectively, of the predetermined portion 98 of end surface 94, best shown in the enlarged view of end portion 98 in FIG. 5. The first and second predetermined surfaces 134 and 136 are those end surface portions of end surface 94 which are covered by suction ring valve 56 during the compression stroke, ie., those surfaces on opposite sides of, and immediately adjacent to, channel 102. The first predetermined surface 134 starts adjacent to the inner edge 106 of channel 102 and extends towards longitudinal axis 28. The second predetermined surface 136 starts adjacent to the outer edge 108 of channel 102 and extends to near the outer circumferential edge 138 of piston 22.

Figure 7:
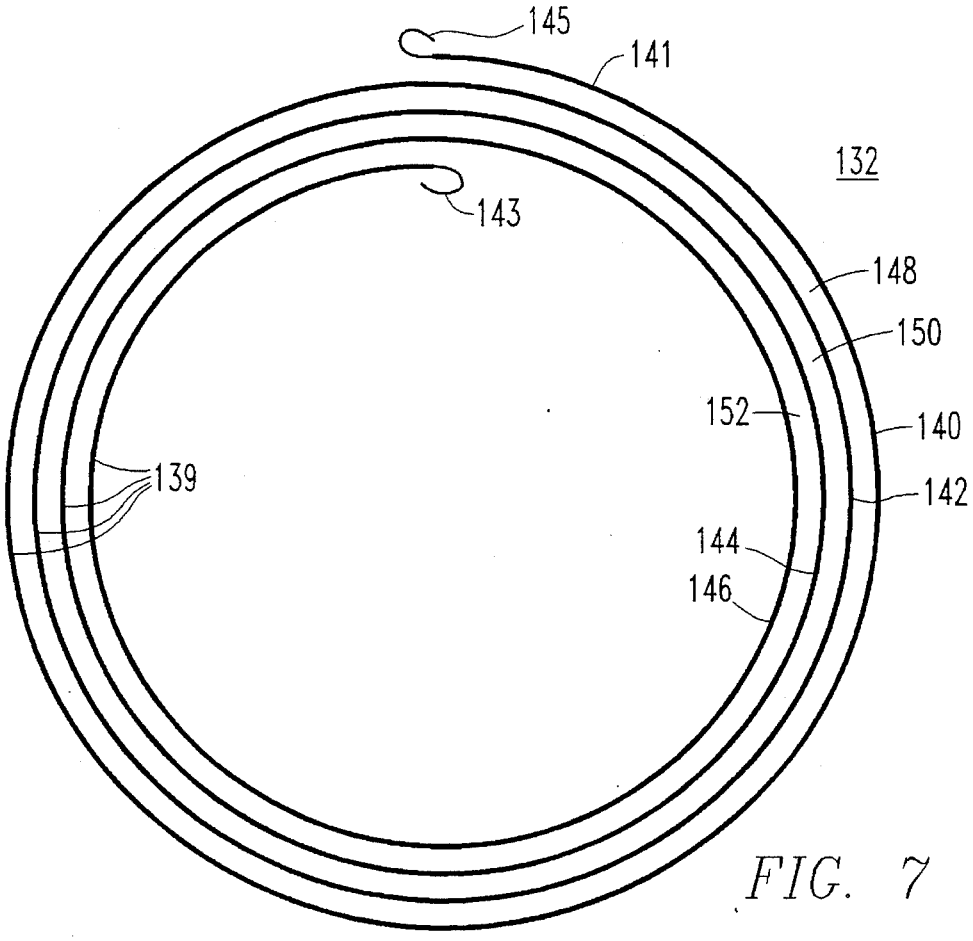
FIG. 7 is an enlarged diagrammatic representation of one of the spiral grooves formed in the flat end surface of the piston shown in FIG. 3, illustrating that the groove is a true spiral groove, having a plurality of nested loops terminated by open inner and outer ends.

It is important that grooves 130 and 132 are in the form of spiral grooves, ie., an open ended phonographic type serration, as illustrated in a greatly enlarged diagrammatic representation of spiral groove 132 in FIG. 7. As illustrated in FIG. 7, spiral groove 132 has a plurality of nested loops 139 which define a continuous channel or depression 141 between inner and outer channel ends 143 and 145, respectively, and a continuous spiral support surface 147 between loops 139.

The spiral grooves 130 and 132 reduce the manufacturing cost involved in providing the grooves, as compared with the manufactured cost involved in providing a plurality of concentric circular grooves; and also because, for reasons not entirely understood, the spiral grooves 130 and 132 provide the desired non-violent opening of suction ring valve 56 at the desired early point in the downward suction cycle, even though spiral grooves 130 and 132 promote an inconsequential pressure leak during the closed position of suction ring valve 56. Perhaps the small pressure leak promoted by the spiral grooves 130 and 132 aids the reduction in stiction forces resulting from the "broken" flat surface provided by spiral grooves 130 and 132, which broken surface reduces surface tension and stiction forces. Perhaps, the small pressure leak reduces the amount of oil trapped in the areas of contact between suction ring valve 56 and the first and second surfaces 134 and 136. The pressure leak is promoted by the spiral groove structure because the spiral groove provides a groove structure which forms a relatively shallow opening which extends across the face of the contacting flat surface 70 of suction ring valve 56, in a direction which provides a pressure leak path, unlike a pattern of spaced concentric circular grooves which would extend around the contacting flat surface 70 concentric with its inner and outer edges.

Spiral grooves 130 and 132 are preferably provided by spinning piston 22 about its longitudinal axis 28 while a sharp tool is moved across the first and second predetermined surfaces 134 and 136 of end surface 94, with the movement of the tool being in a direction perpendicular to longitudinal axis 28. Spiral grooves 130 and 132 may thus be portions of a single spiral groove formed in the piston casting before annular channel is formed; or, spiral grooves 130 and 132 may be formed after annular channel 102 is formed, as desired.

FIG. 8 is a greatly enlarged cross sectional view of the second predetermined surface 136 of the predetermined portion 98 of end surface 94 of piston 22, illustrating spiral groove 132. The adjacent loops 139 (FIG. 7) of the phonographic serration which defines spiral groove 132 create, in the cross sectional view of FIG. 8, a plurality of depressions or channels, such as curved channels 140, 142, 144 and 146. Curved channels 140, 142, 144 and 146 are separated by flat portions 148, 150 and 152. The flat portions 148, 150 and 152 are in the same plane as end surface 94, since they are part of end surface 94, and they create a spiral support surface for the lower surface 70 of suction ring valve 56. The relatively shallow curved channels 140, 142, 144 and 146 of the plurality of loops of the spiral depression break up the flat surface to reduce surface tension, and they provide a basin for collecting compressor lubricating oil 16.

In an exemplary embodiment of spiral groove 132, the shallow curved channels 140, 142, 144 and 146 may have a depth 154 of about 0.003 inch (0.08 mm), with the curved portions of the channels each having a radius 156 of about 0.015 inch (0.38 mm), creating flat intermediate portions 148, 150 and 152 with a width dimension 158 of about 0.005 inch (0.13 mm) when the spacing 160 between adjacent centers 161 of the shallow curved channels 140. 142, 144 and 146 is about 0.023 inch (0.58 mm).

In the prior art the continuous channel 102 type of construction was used to reduce the amount of end surface 94 in contact with surface 70 of suction ring valve 56, in an attempt to reduce stiction forces. This lack of support in the intermediate annular portion of the suction ring valve 56, however, also leads to stresses in suction ring valve 56 during the compression stroke. These stresses, formed in an intermediate annular portion of suction ring valve 56, may aid the slamming shock forces in leading to premature failure of suction ring valve 56. The present invention, which includes spiral grooves 130 and 132 in the areas of contact between surfaces of the suction ring valve 56 and surfaces 134 and 136 of piston 22, enables a different piston construction to be utilized which provides additional support for suction ring valve 56 in the intermediate annular portion of surface 70, without creating significant additional stiction forces.

Figure 11:
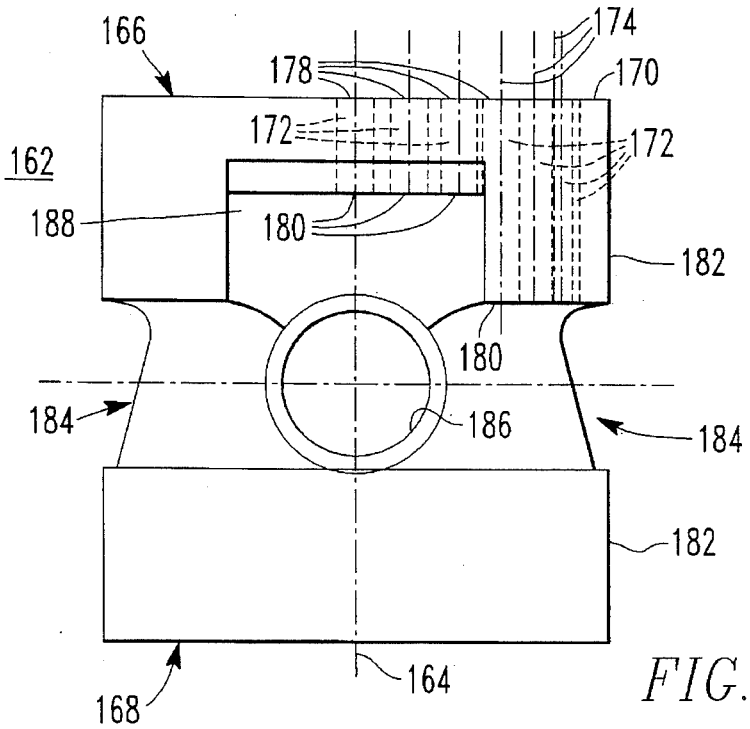
FIG. 11 is an elevational view of the piston shown in FIGS. 8 and 9, illustrating an exemplary construction of the piston to accommodate the plurality of openings which are located above the ends of a transverse wrist pin opening in the piston.
Figure 9:
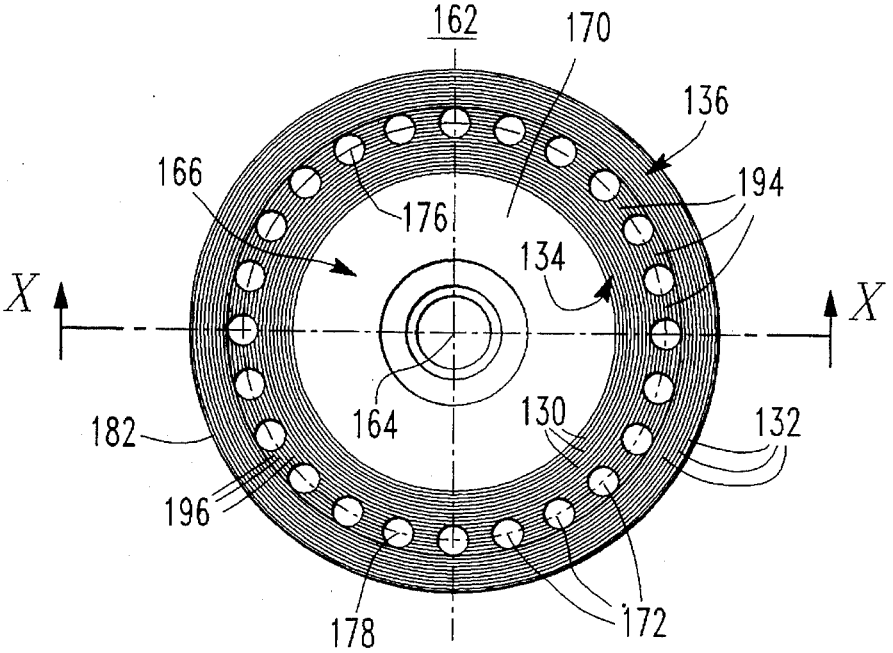
FIG. 9 is an end view of a piston constructed according to another embodiment of the invention, in which a spiral groove is provided in an end surface of a piston which has a series of closely spaced openings which extend to the grooved end surface of the piston, providing additional support for the suction ring valve by the end surfaces located between the openings, without adding significantly to deleterious "stiction" forces due to the spiral grooves formed in the end surfaces of the piston located on each side of, and between, the series of openings.
Figure 10:
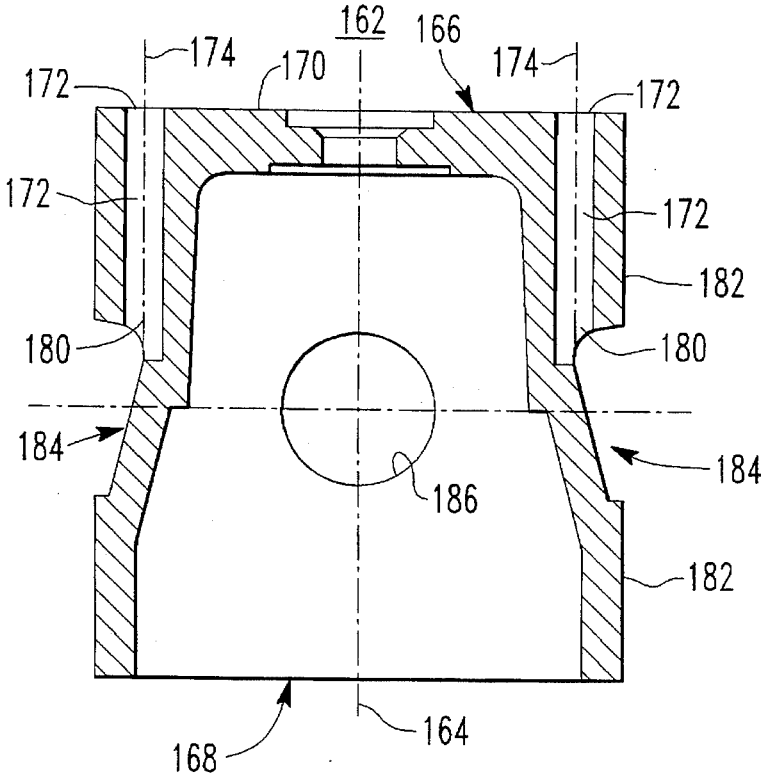
FIG. 10 is a cross sectional view of the piston shown in FIG. 9, taken between and in the direction of arrows X—X in FIG. 9.

FIGS. 9, 10, and 11 illustrate a piston 162 constructed according to an embodiment of the invention which combines the spiral grooves 130 and 132 of the first embodiment with a piston construction which provides additional support for surface 70 of suction ring valve 56. FIG. 9 is a plan view of the suction valve end of piston 162, illustrated without suction ring valve assembly 46. FIG. 10 a sectional view taken between and in the direction of arrows X—X in FIG. 9, and FIG. 11 an elevational view of a wrist pin side of piston 162.

Piston 162 has a cylindrical configuration, including a longitudinal axis 164 and first and second longitudinal ends 166 and 168, respectively. The first longitudinal end 166 has an end surface 170. End surface 170 has spiral grooves 130 and 132 which may be identical to spiral grooves 130 and 132 of the first embodiment of piston 22, and thus they are given the same reference numbers. Spiral grooves 130 and 132 are also disposed in first and second predetermined surfaces 134 and 136 of a predetermined end portion 98 of the end surface 170 of piston 162, which may be the same end surfaces as the like numbered elements of piston 22.

The major differences between piston 162 and piston 22 include the fact that instead of having the annular channel 102 formed in the first longitudinal end 24 of piston 22, piston 162 is provided with a plurality of spaced openings 172, which, as illustrated, may have a circular cross sectional configuration. Each opening 172 has a longitudinal axis 174 parallel with longitudinal axis 164, with the longitudinal axes 174 all lying upon an imaginary circle which is concentric with longitudinal axis 164, with this imaginary circle being illustrated by a portion of a broken circle 176 in FIG. 9. Each opening 172 has a first open end 178 which starts at end surface 170, and a second open end 180. A cylindrical outer surface 182 of piston 162 is provided with a pair of circumferential spaced depressions or inwardly stepped side portions 184 intermediate the first and second longitudinal ends 166 and 168, with the majority of the second open ends 180 communicating with depressions 184. The openings 172 which lie immediately above a transverse opening 186 for receiving a wrist pin (not shown) do not communicate with depressions 184, as depressions 184 do not extend through the portions of piston 162 which define wrist pin opening 186. As shown in FIG. 11, an auxiliary depression 188 is provided in the cylindrical outer surface 182 above each end of wrist pin opening 186. Thus, the second open ends 180 of the openings 172 which lie directly above the wrist pin opening 186 communicate with auxiliary depression 188.

In an exemplary embodiment of piston 162, the circle 176 upon which the longitudinal axes 174 of openings 174 lie has a diameter of about 1.83 inches (4.65 cm), with twenty four openings 172 each having a diameter of about 0.16 inch (4 mm) being disposed in spaced relation to provide a flat support surface 194 between each pair of adjacent openings 172. The plurality of support surfaces 194 are located to support the annular central or intermediate portion of suction ring valve 56 during the compression stroke of piston 162, preventing severe bending stresses from being created in suction ring valve 56 during the compression stroke.

In a preferred embodiment of piston 162, the spiral grooves 130 and 132 are in effect one continuous groove, broken only by openings 172. Thus, the surfaces 194 between openings 172 includes grooves 196. The additional support for suction ring valve 56 is thus provided without adding significantly to stiction forces created between suction ring valve 56 and piston 162. The spiral groove in this embodiment of the invention may be provided in end surface 170 of piston 162 before, or after, the plurality of openings 172 are formed in the piston casting, as desired.

I claim:

1. A refrigerant compressor having a cylinder assembly which includes a piston having first and second longitudinal ends, and a longitudinal axis which extends therebetween, with the piston being mounted for reciprocal movement within a cylinder to provide suction and compression strokes which respectively introduce and compress a refrigerant vapor which may have entrained compressor lubricant, a suction ring valve is provided at the first longitudinal end of the piston which is operated by pressure differentials during the suction and compression strokes such that the suction ring valve contacts predetermined end surfaces at the first longitudinal end of the piston during the compression stroke to close a refrigerant vapor supply opening surrounded by the predetermined end surfaces, and such that the suction ring valve is raised from the predetermined end surfaces during the suction stroke to open the refrigerant vapor supply opening and introduce refrigerant vapor into a compression chamber of the cylinder assembly, characterized by:

said predetermined end surfaces of the piston including an open ended spiral groove having a plurality of loops which provide a spiral support surface for the suction ring valve, and a spiral depression which collects compressor lubricant entrained in refrigerant vapor, to provide support for the suction ring valve while reducing stiction forces created between the suction ring valve and the piston.

2. The refrigerant compressor of claim 1 wherein the refrigerant vapor supply opening surrounded by the predetermined end surfaces of the piston includes an annular channel having inner and outer edges concentric with the longitudinal axis of the piston, with the predetermined end surfaces of the piston contacted by the suction ring valve including first and second predetermined end surfaces which are respectively adjacent to the inner and outer edges of said annular channel.

3. The refrigerant compressor of claim 1 wherein the refrigerant vapor supply opening surrounded by the predetermined end surfaces of the piston includes a plurality of spaced openings, each of said plurality of spaced openings extending to, and being surrounded by, the predetermined end surfaces of the piston which are in contact with the suction ring valve during the compression stroke, to provide additional support surfaces for the suction ring valve between adjacent openings.

4. The refrigerant compressor of claim 3 wherein loops of the spiral groove are provided between the plurality of spaced openings, with the spiral groove extending from opening to opening in the additional support surfaces disposed between adjacent openings.

5. The refrigerant compressor of claim 3 wherein the plurality of spaced openings each have a longitudinal axis parallel with the longitudinal axis of the piston, and wherein the plurality of spaced openings are located in a circular pattern concentric with the longitudinal axis of the piston.

6. The refrigerant compressor of claim 3 wherein the plurality of spaced openings each have a circular cross sectional configuration.

7. The refrigerant compressor of claim 1 wherein the suction ring valve includes a metallic disc having predetermined inner and outer diameters and a predetermined thickness dimension which terminates in first and second surfaces which are devoid of any openings, with the first surface being a smooth flat surface which contacts the predetermined end surfaces of the piston during a compression stroke of the piston.

8. The refrigerant compressor of claim 1 wherein the open ended spiral groove defines a depression having a maximum depth dimension of about 0.08 mm, and wherein the plurality of loops of the spiral groove are spaced are from one another by a dimension of about 0.13 mm, which dimension defines the width of the spiral support surface.

9. The refrigerant compressor of claim 8 wherein the depression has a curved configuration having a radius of about 0.38 mm, with the center of the curved configuration of one loop of the spiral groove being spaced from the center of the curved configuration of an adjacent loop by a dimension of about 0.58 mm.

* * * * *